US009504285B2

(12) United States Patent
Lin

(10) Patent No.: US 9,504,285 B2
(45) Date of Patent: Nov. 29, 2016

(54) EYELASH HOLDER

(71) Applicant: Pro-Iroda Industries, Inc., Taichung (TW)

(72) Inventor: Yu-Chih Lin, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

(21) Appl. No.: 14/683,183

(22) Filed: Apr. 10, 2015

(65) Prior Publication Data

US 2015/0351476 A1 Dec. 10, 2015

(30) Foreign Application Priority Data

Jun. 10, 2014 (TW) ..... 103210149 U

(51) Int. Cl.

| | |
|---|---|
| ***B65D 71/00*** | (2006.01) |
| ***A41G 5/02*** | (2006.01) |
| ***B65D 73/00*** | (2006.01) |
| ***B65D 25/10*** | (2006.01) |
| *B65D 1/36* | (2006.01) |

(52) U.S. Cl.

CPC ..... *A41G 5/02* (2013.01); *B65D 25/10* (2013.01); *B65D 25/108* (2013.01); *B65D 73/00* (2013.01); *B65D 1/36* (2013.01)

(58) Field of Classification Search

CPC .... A41G 3/0041; A41G 3/0058; A41G 5/02; A45D 44/00; B65D 1/36; B65D 15/106; B65D 15/107; B65D 15/108; B65D 71/70; B65D 73/00; B65D 25/106; B65D 25/107; B65D 25/108

USPC ..... 132/216

See application file for complete search history.

(56) References Cited

U.S. PATENT DOCUMENTS

| | | | | |
|---|---|---|---|---|
| 3,333,593 | A | 8/1967 | McGivern | |
| 3,491,775 | A | 1/1970 | Aylott | |
| 3,591,032 | A * | 7/1971 | Baxter | B65D 1/36 108/53.1 |
| 5,996,802 | A * | 12/1999 | Parker | A47F 7/0071 206/563 |
| D582,265 | S * | 12/2008 | Helfman | D9/425 |
| 9,044,077 | B1 * | 6/2015 | Lin | A45D 44/00 |
| 2013/0160787 | A1 * | 6/2013 | Chae | A41G 5/02 132/201 |
| 2015/0173442 | A1 * | 6/2015 | Raouf | B65D 21/0209 132/286 |

FOREIGN PATENT DOCUMENTS

| | | | |
|---|---|---|---|
| JP | S4824687 | U | 3/1973 |
| JP | S492684 | Y1 | 1/1974 |
| JP | 3043848 | U | 12/1997 |
| JP | 3167442 | U | 4/2011 |
| JP | 2011177395 | A | 9/2011 |
| TW | M401345 | M | 4/2011 |

* cited by examiner

*Primary Examiner* — Anthony Stashick
*Assistant Examiner* — Mollie Llewellyn
(74) *Attorney, Agent, or Firm* — Alan D. Kamrath; Kamrath IP Lawfirm, P.A.

(57) ABSTRACT

An eyelash holder includes a base and at least one eyelash mount supported on the base. The eyelash holder has a curved lateral side defining an eyelash positioning edge, and includes two holding slots being distal from one another and extending into the eyelash positioning edge.

14 Claims, 5 Drawing Sheets

EYELASH HOLDER

BACKGROUND OF THE INVENTION

1. Field of the Invention

The present invention relates to an eyelash holder and, particularly, to an eyelash holder allowing an eyelash to connect thereto and disconnect therefrom conveniently.

2. Description of the Related Art

TW Patent No. 401345 shows an eyelash holder including at least one eyelash and a base bearing the at least one eyelash. The eyelash holder can hold an eyelash with the at least one eyelash mount. The at least one eyelash mount is of a crescent shape. Therefore, an eyelash, which is normally of a crescent shape can conformingly connect to the at least one eyelash mount. In addition, an eyelash has two distal ends thereof adhering to the eyelash mount in order to be fixedly held and to avoid deformation. However, it is difficult to release the eyelash from such eyelash mount. A user would have to use a tool to break adhesive connections between the eyelash mount and the eyelash connected thereto, and to cut off the two distal ends of the eyelash to avoid deforming and breaking the eyelash.

The present invention, therefore, obviates or at least alleviates the problems encountered in the prior art.

SUMMARY OF THE INVENTION

According to the present invention, an eyelash holder includes a base and at least one eyelash mount supported on the base. The eyelash holder has a curved lateral side defining an eyelash positioning edge, and includes two holding slots being distal from one another and extending into the eyelash positioning edge.

An eyelash has an eyelash strip. Two distal lengths of the eyelash strip are restrained respectively in the two holding slots when the eyelash connects to the eyelash mount and is fixedly stored in the eyelash holder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide an eyelash holder including an eyelash mount for storing an eyelash.

It is another objective of the present invention to provide an eyelash holder so that eyelashes are able to connect thereto and disconnect therefrom easily and conveniently.

It is yet another objective of the present invention to provide an eyelash holder that prevents eyelashes being disconnected therefrom from suffering deformation and breakage.

Other objectives, advantages, and new features of the present invention will become apparent from the following detailed description of the invention when considered in conjunction with the accompanied drawings.

DETAILED DESCRIPTION OF THE INVENTION

Figure 1:
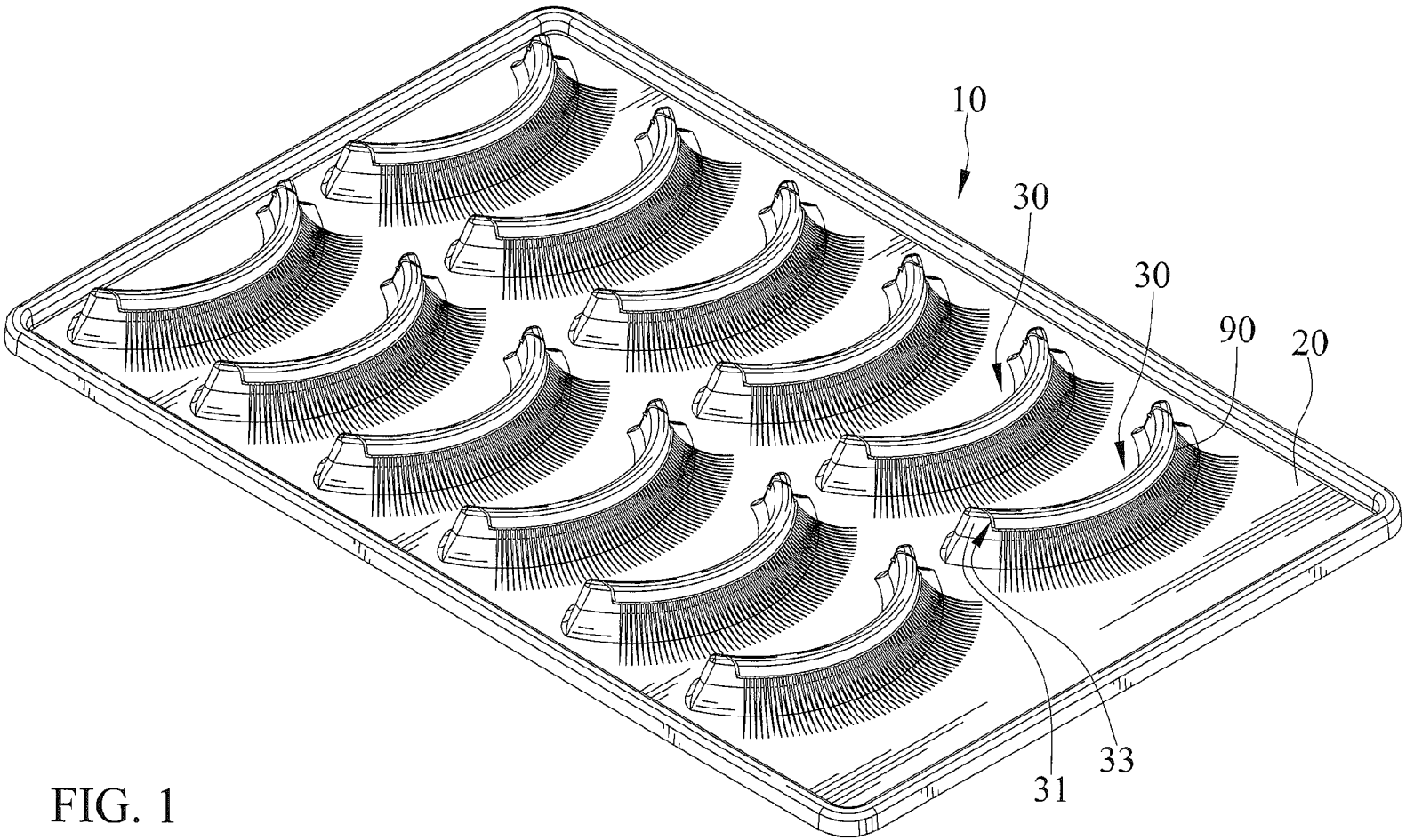
FIG. 1 is a perspective view of an eyelash holder in accordance with the present invention holding and displaying a plurality of eyelashes.
Figure 2:
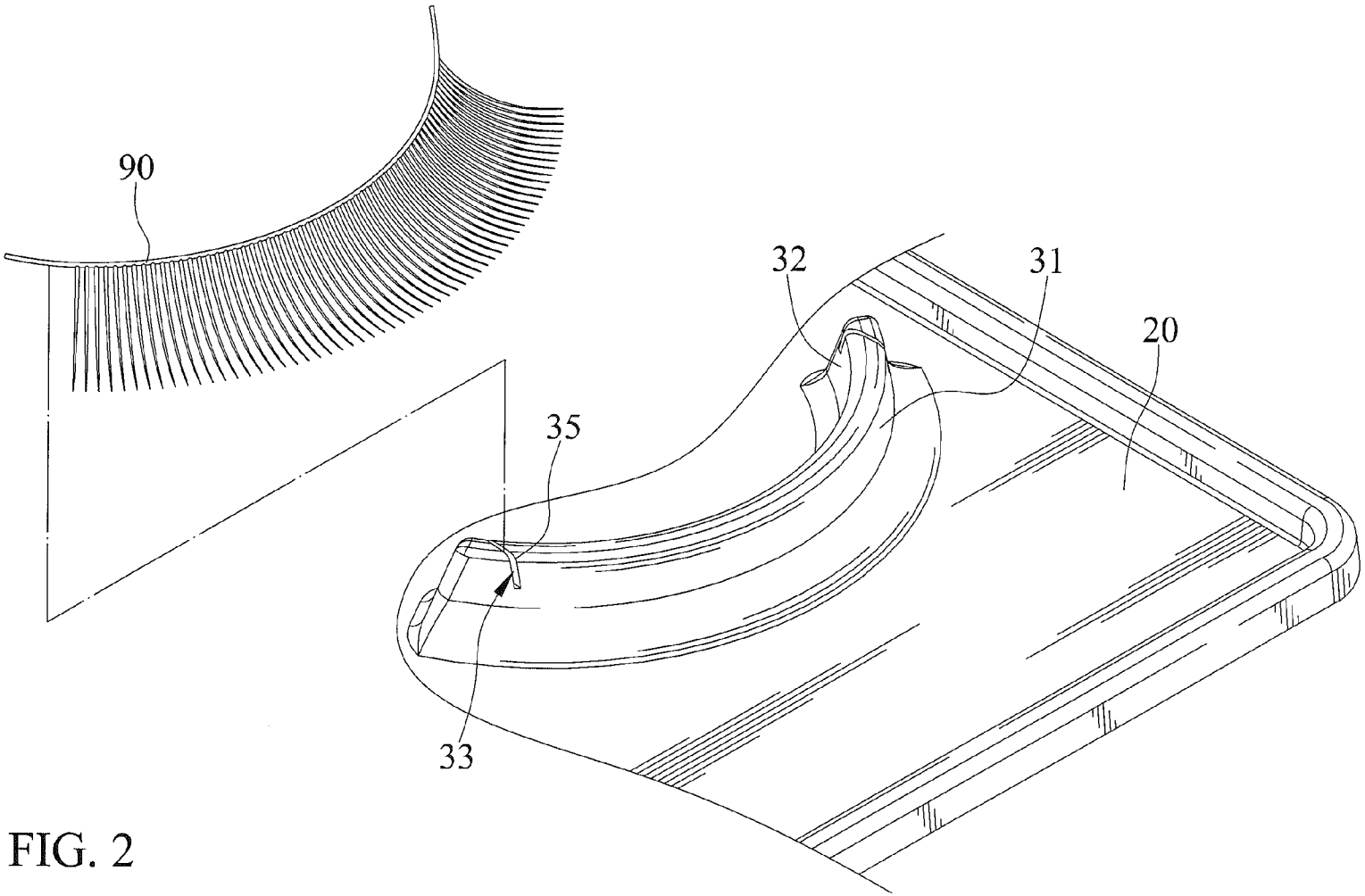
FIG. 2 is a partial, exploded perspective view of the eyelash holder of the present invention and an eyelash connected thereto.
Figure 3:
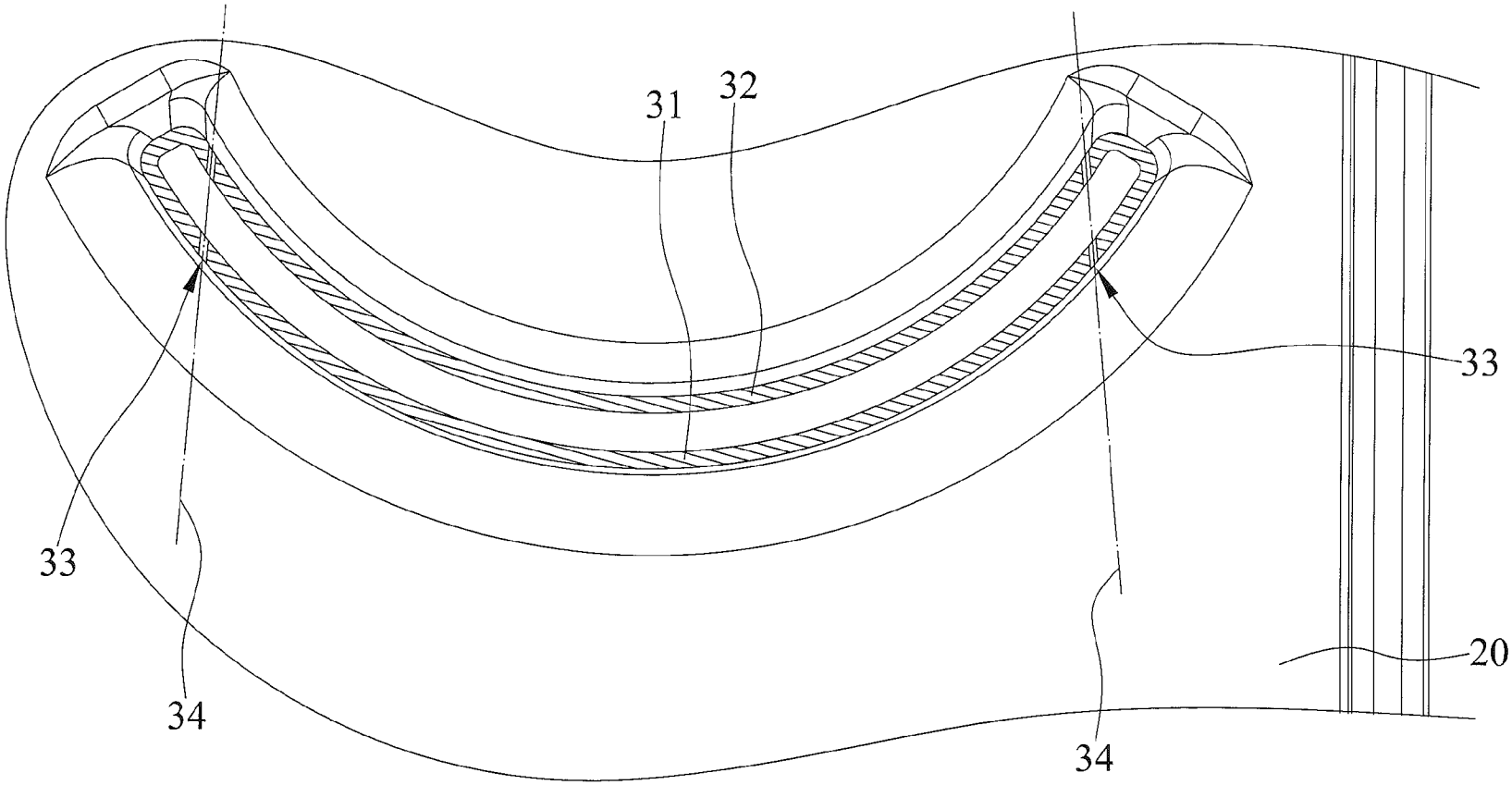
FIG. 3 is a partial, cross-sectional view of the eyelash holder of the present invention.
Figure 4:
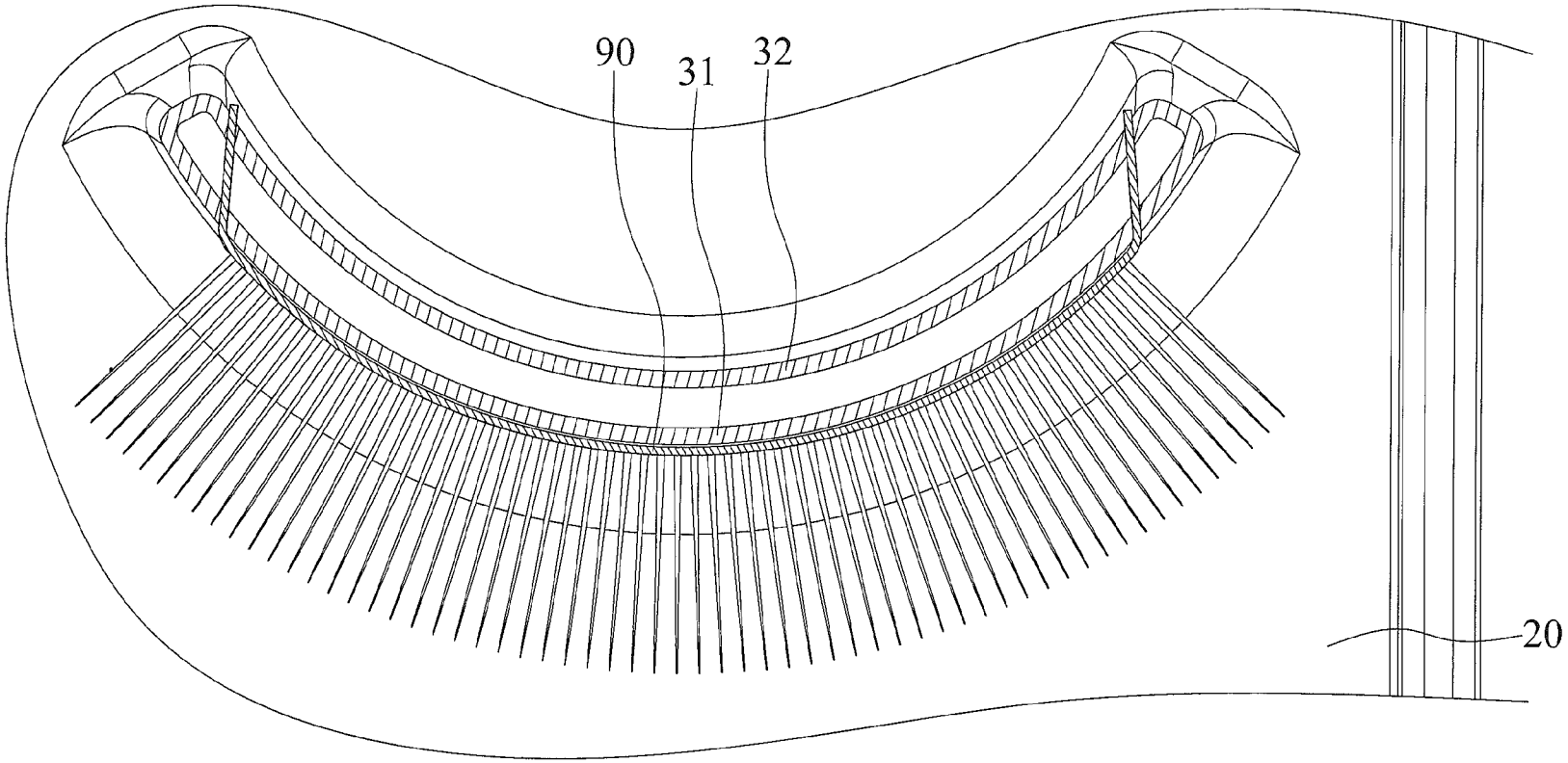
FIG. 4 is an extended cross-sectional view of FIG. 3, with the eyelash holder holding an eyelash.
Figure 5:
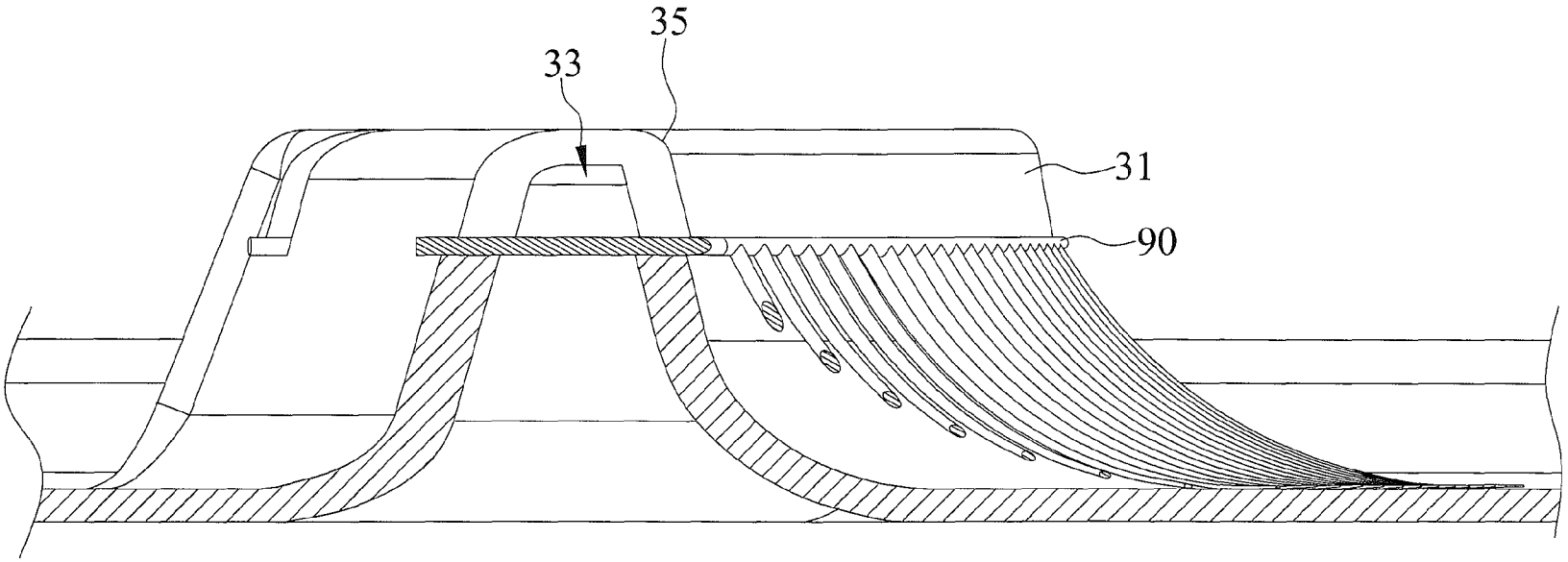
FIG. 5 is a partial, cross-sectional view of the eyelash holder of the present invention and an eyelash connected thereto.

FIGS. 1 through 5 show an eyelash holder 10 in accordance with the present invention. The eyelash holder 10 includes a base 20 and at least one eyelash mount 30.

The base 20 bears and supports at least one eyelash mount 30. The at least one eyelash mount 30 is disposed on a side of the base 20. The side of the base 20 forms a flat surface. The at least one eyelash mount 30 protrudes above the side of the base 20. In the embodiment, the at least one eyelash mount 30 includes a plurality of eyelash mounts 30. In the embodiment, the plurality of eyelash mounts 30 is arranged in two columns, but is not limited thereto.

The at least one eyelash mount 30 has a top edge, a bottom edge, and two curved lateral sides. The two curved lateral sides are opposite from one another. The at least one eyelash mount 30 includes the top edge thereof extending to a top of one of the two curved lateral sides to a top of the other of the two curved lateral sides. The at least one eyelash mount 30 includes the bottom edge thereof extending to a bottom of one of the two curved lateral sides to a bottom of the other of the two curved lateral sides. The at least one eyelash mount 30 includes the bottom edge thereof disposed and supported on the base 20. The at least one eyelash mount 30 includes the top edge thereof at a height above the base 20. The at least one eyelash mount 30 has a first distal end and a second distal end distal to the first distal end in a first direction, and each of the two curved lateral sides curves from the first distal end to the second distal end of the at least one eyelash mount 30 in the first direction. The at least one eyelash mount 30 includes one of the two curved lateral sides defining an eyelash positioning edge 31 and the other defining an back edge 32, respectively. The at least one eyelash mount 30 includes the top edge thereof extending to a top of eyelash positioning edge 31 and to a top of the back edge 32. The at least one eyelash mount 30 includes the bottom edge thereof extending to a bottom of eyelash positioning edge 31 and to a bottom of the back edge 32. The at least one eyelash mount 30 between the first and second distal ends thereof has a concavo-convex shape, with the eyelash positioning edge 31 being convex, and with the back edge 32 being concave. The eyelash positioning edge 31 and the back edge 32 is sloped. The eyelash positioning edge 31 and the back edge 32 each slant from the top to the bottom thereof in a second direction and define a sloped edge. The second direction is transverse to the first direction. The eyelash positioning edge 31 and the back edge 32 each curve in the second direction. The eyelash positioning edge 31 and the back edge 32 curve away from each other from the top edge to the bottom edge of the at least one eyelash mount 30. The at least one eyelash mount 30 includes two holding slots 33. The two holding slots 33 extend into the eyelash positioning edge 31. The two holding slots 33 extend for a length in a third direction. The third direction is transverse to either the first or second direction. Each of the two holding slots 33 extends along a phantom axis 34. The phantom axis 34 extends in the third direction. The two holding slots 33 extend parallel to one another in the third direction. The two holding slots 33 extend for a depth from the top edge of the at least one eyelash mount 30. The depth of each of the two holding slots 33 is smaller than a height of the at least one eyelash mount 30. The two holding slots 33 extend to the back edge 32. Each of the two holding slots 33 forms an opening 35. The opening 35 extends to the eyelash positioning edge 31. The opening 35 also extends to the top edge and the back edge 32 of the at least one eyelash mount 30. The two holding slots 33 are distal from one another. The two holding slots 33 include one adjacent to the first distal end of the at least one eyelash mount and the other adjacent to the second distal end of the at least one eyelash mount 30, respectively.

An eyelash 90 has an eyelash strip and a plurality of individual lashes extending transversely from a middle length of the eyelash strip. The eyelash strip has a first distal length defining a first connecting end and a second distal length defining a second connecting end, respectively. The middle length is defined between the first and second distal length. The lashes don't extend from the first and second connecting ends. The eyelash 90 can be fixedly stored in the eyelash holder 10 in that the first connecting end is restrained in one of the two holding slots 33 and the second connecting end is restrained in the other of the two holding slots 33, respectively. The eyelash 90 includes the plurality of individual lashes draping on the eyelash positioning edge 31. The plurality of individual lashes draping on the eyelash positioning edge 31 can keep curved.

The base 20 and the at least one eyelash mount 30 are made out of a material and become a one-piece structure. The base 20 and the at least one eyelash mount 30 are injection molded.

In view of the forgoing, the design of the two holding slots 33 allows the eyelash 90 to be able to be stored in the at least one eyelash mount 30 easily and conveniently without suffering problems that the first and second connecting ends of the eyelash 90 release from the respective holding slot 33 easily, or the eyelash 90 disconnect from the at least one eyelash mount 30 inadvertently easily, or the eyelash 90 being disconnected from the at least one eyelash mount 30 deforms and breaks. The eyelash strip of the eyelash 90 is flexible, and since the two holding slots 33 extend parallel to one another, the first and second connecting ends of the eyelash 90 are equally tensioned and are less liable to detach from the at least one eyelash mount 30.

The foregoing is merely illustrative of the principles of this invention and various modifications can be made by those skilled in the art without departing from the scope and spirit of the invention.

What is claimed is:

1. An eyelash holder comprising:

a base; and at least one eyelash mount supported on the base, with the at least one eyelash mount having a first distal end, a second distal end distal to the first distal end in a first direction, and first and second curved lateral sides curving from the first distal end to the second distal end, wherein the first and second curved lateral sides are opposite from one another and extend from a top edge to a bottom edge, the at least one eyelash mount including two holding slots distal from one another and extending into the first curved lateral side, wherein the first and second curved lateral sides curve away from each other from the top edge to the bottom edge of the at least one eyelash mount.

2. The eyelash holder as claimed in claim 1, wherein the two holding slots extend transversely to the first direction.

3. The eyelash holder as claimed in claim 1, wherein the two holding slots extend parallel to one another into the at least one eyelash mount.

4. The eyelash holder as claimed in claim 2, wherein the two holding slots extend into the second curved lateral side.

5. The eyelash holder as claimed in claim 1, wherein the first curved lateral side is convex.

6. The eyelash holder as claimed in claim 4, wherein the at least one eyelash mount has a concavo-convex shape, with the first curved lateral side being convex, and with the second curved lateral side being concave.

7. The eyelash holder as claimed in claim 2, wherein the first curved lateral side is sloped and slants from the top edge to the bottom edge thereof in a second direction, and wherein the second direction is transverse to the first direction.

8. The eyelash holder as claimed in claim 6, wherein the first curved lateral side and the second curved lateral side are sloped and each slant from the top edge to the bottom edge thereof in a second direction, and wherein the second direction is transverse to the first direction.

9. The eyelash holder as claimed in claim 7, wherein the top edge is at a height above the base and the bottom edge is supported on the base respectively.

10. The eyelash holder as claimed in claim 8, wherein the top edge is at a height above the base and the bottom edge is supported on the base respectively.

11. The eyelash holder as claimed in claim 1, wherein the at least one eyelash mount includes a plurality of eyelash mounts arranged in an array.

12. The eyelash holder as claimed in claim 1, wherein each of the at least two holding slots form an opening extending into the first curved lateral side.

13. The eyelash holder as claimed in claim 9, wherein the two holding slots extend into the top edge of the at least one eyelash mount, and wherein each of the at least two holding slots form an opening extending from the first curved lateral side to the top edge.

14. The eyelash holder as claimed in claim 10, wherein the two holding slots extend into the top edge and the second curved lateral side of the at least one eyelash mount, and wherein each of the at least two holding slots forms an opening extending from the first curved lateral side to, the top edge and the second curved lateral side.

* * * * *